United States Patent [19]

Davis

[11] Patent Number: 4,915,173

[45] Date of Patent: Apr. 10, 1990

[54] METHOD FOR STAGED PLACEMENT OF GRAVEL PACKS

[75] Inventor: Bruce E. Davis, Houston, Tex.

[73] Assignee: Dowell Schlumberger Incorporated, Tulsa, Okla.

[21] Appl. No.: 281,151

[22] Filed: Dec. 7, 1988

[51] Int. Cl.[4] ..... E21B 43/04

[52] U.S. Cl. ..... 166/278

[58] Field of Search ..... 166/278, 276, 51, 280

[56] References Cited

U.S. PATENT DOCUMENTS

| | | | |
|---|---|---|---|
| 3,896,877 | 7/1975 | Vogt, Jr. et al. | 166/280 |
| 4,126,181 | 11/1978 | Black | 166/280 |
| 4,378,845 | 4/1983 | Medlin et al. | 166/278 |
| 4,512,405 | 4/1985 | Sweatman et al. | 166/278 |
| 4,566,539 | 1/1986 | Perlman | 166/280 |
| 4,665,990 | 5/1987 | Perlman | 166/280 |

*Primary Examiner*—Bruce M. Kisliuk

*Attorney, Agent, or Firm*—Stephen A. Littlefield

[57] ABSTRACT

A well penetrating a subterranean fluid producing formation can effectively be gravel packed by a process which begins with an initial low gravel loading in the carrier fluid, the gravel loading gradually being increased over the course of the gravel packing operation to provide a complete gravel pack including a gravel reservoir without formation breakdown, fluid loss, bridging and/or sand-out of the gravel pack fluid.

5 Claims, No Drawings

METHOD FOR STAGED PLACEMENT OF GRAVEL PACKS

This invention relates to the art of wellbore sand control and, more particularly, to a process of gravel pack placement which avoids high gravel loadings early in the process in which the resultant high hydrostatic pressure could cause formation breakdown, sand-out and/or bridging in the well.

BACKGROUND OF THE INVENTION

The process of gravel packing to restrict and control the passage of particulate materials from a subterranean formation into a well which penetrates the formation is well-known. The process of gravel packing basically comprises a mixing of a selected size-grading of gravel, sand or other particulate material in a fluid carrier and pumping the resulting slurry down the annulus between the wellbore wall or well casing and a centrally located well screen or perforated liner. The fluid carrier filters through the screen and is returned to the surface leaving a porous permeable pack of granular material in the wellbore annulus between the wall of the wellbore and the well screen. This porous pack substantially reduces the migration of particles from the formation into the well as well as reducing the associated problems of equipment erosion and wellbore plugging when fluids containing such formation particles are produced.

In addition to forming a granular filter pack in the wellbore annulus, some of the gravel and carrier fluid travels through casing perforations into the formation itself. While such technique effectively enlarges the gravel pack with its attendant advantages, formation damage can result from large amounts of fluid carrier material being "filtered out" into the formation. Additionally, high pressure gravel packing can cause actual formation breakdown and rapid fluid loss in the gravel pack slurry which will result in sand bridging at a particular location. Bridging can effectively reduce or totally stop the overall gravel packing process in other locations in the well. This is particularly true when there is a low formation pressure counteracting the hydrostatic pressure of a conventional packing process.

Gravel packing is typically carried out in accordance with a so-called slurry-pack process such as is described in U.S. Pat. No. 3,498,380. In accordance with the slurry-pack process, an aqueous carrier fluid is thickened with a gelling agent such as a natural or synthetic gum, polysaacharide, polyacrylamide polymers, cellulose derivatives and the like. This thickened fluid is capable of carrying up to twenty pounds of particulate material such as sand per gallon of fluid. Typically, sand loadings of ten to fifteen pounds per gallon are used. With sand loadings of this magnitude, the hydrostatic pressure created on the formation in even a moderately deep well can be substantial. If formation pressures are substantially exceeded by the hydrostatic pressure, breakdown of the formation and rapid loss of the gravel pack fluid material under the formation can occur with the results being an incomplete gravel pack due to sand-out or bridging as well as the possibility for substantial formation damage with the influx of large amounts of fluid carrier material.

The complications involved in a slurry pack process at low formation pressures are even further aggravated by a completion involving several producing zones over a long interval such as may be typical in a gas well wherein several formation layers produce into a single wellbore annulus having a continuous gravel pack. Formation breakdown and resultant bridging or sand-out in one stratum can result in failure to complete the remaining portions of the gravel packing of the entire wellbore.

Other methods of completing a long interval are costly, time consuming and complicated either by high hydrostatic pressures or difficult and complicated completion methods. The well-known pre-pack/sand injector-type gravel pack can occassionaly be used over a long interval but formations having low formation pressure eliminate this process since the foam clean-out of pre-packed sand using a nitrogen foam at high pressures can cause formation damage under such low formation pressure conditions. Further, there is a significant cost in this process due to the additional equipment, time and manpower required over simplier processes. Additionally, it is difficult to build a significant sand reservoir above the screen top since the sand injection process contains only relatively low sand loadings throughout the process.

The final, most complex method for completion of gravel pack operations for several producing formations over a long interval would be a process whereby individual zones were isolated with a packer and, upon, completion of the gravel packing of such zone, other packers are then set across other intervals for additional gravel packing and continuing this process until the entire interval is completed. The complications involved in multiple packer settings, precise control of sand injection pressures over several operations and the strong possibility that a single failed packing operation could destroy the effectiveness of the entire gravel pack are apparent.

In a typical gravel pack operation, an excess of particulate material is packed into the wellbore annulus above the screen and perforations to act as a reservoir of additional particulate material which can settle into the screen/perforation area if a void occurs in the initial gravel pack or as the result of gravel loss through the screen during production. Again, a relatively high sand loading in the fluid carrier material in order to build up this reservoir results in high hydrostatic pressures which could result in the aforementioned problems of formation breakdown, fluid loss and bridging. Low sand loadings require an extended pumping period to build a sufficient release of sand for the reservoir.

Under normal conditions, a formation is typically acidized prior to the placement of a gravel pack. The acid penetrates the formation dissolving soluble particulate materials and enlarging fluid passages so that formation fluids are more easily produced. However, under low bottomhole pressure conditions, prior acidizing can aggravate the chances of formation breakdown during gravel packing with the resulting problems associated therewith.

SUMMARY OF THE INVENTION

The present invention provides a process for overcoming the problems of low bottomhole pressure and/or gravel packing of several layers of formation over a long interval without the problems of formation breakdown, fluid loss, bridging and/or sand-out.

In accordance with the invention, an aqueous carrier fluid initially containing a relatively low amount of granular particulate material is pumped into the wellbore annulus resulting in relatively low hydrostatic pressure. The granular particulate material migrates to the zones of greatest fluid loss within the producing interval and begins to pack into the well perforations in that area. The sand loading in the carrier fluid is gradually increased over time with the granular particulate material being deposited in locations of lesser fluid loss due to a diverting effect of the gravel packing in the areas of greater fluid loss. The process continues with increasing sand loadings until the entire wellbore is packed and a sufficient reservoir above the screen and perforations is in place.

Further in accordance with the invention, the above gravel packing process is then followed by a normal formation acidizing treatment which opens formation passages for the return lost gravel pack placement carrier fluid and the influx of formation fluids into the wellbore for production.

It is therefore an object of this invention to provide a process whereby the problems of gravel packing of a formation can be overcome without formation breakdown, fluid loss, bridging and/or sand-out during the gravel pack process.

It is another object of this invention to provide a process whereby gravel packing of several producing layers over a long interval can be effectively accomplished in a single operation while avoiding formation breakdown, large fluid loss into the formation, bridging and/or screen-out during the gravel pack process.

It is yet another object of this invention to provide a process whereby a sufficient reservoir of gravel pack material is provided above the perforations and screen without the use of initially high sand loadings resulting in high hydrostatic pressures.

DETAILED DESCRIPTION OF THE PREFERRED EMBODIMENTS

The invention will be illustrated by a detailed description of a preferred embodiment thereof. It will be understood by those skilled in the art that variations and modifications of the preferred process may be effected without departing from the scope of the present invention.

As used in this specification, the term "gravel" shall be understood to include any particulate material such as gravel, sand, bauxite, ceramic beads or other material used in a gravel packing operation. In a gravel packing treatment, gravel is placed in the wellbore area against a permeable formation or within perforations through a well casing into a permeable formation. The gravel supports the formation wall and prevents caving in of loose materials against the well liner or screen. Further, the gravel pack serves to restrain sand or other fine particulate materials from unconsolidated and distintegrating strata from entering into the well and severely restricting formation fluid production. The size of the gravel particles is selected so that the interstitial space between the particles effectively filters small formation particles without unduly restricting the flow of well fluids into the wellbore. Generally, gravel having a size of less than 20 mesh (U.S. Standard Sieve series) down to about 100 mesh is satisfactory with 20 to 40 mesh sand being preferred.

A carrier fluid having sufficient viscosity to maintain the gravel in suspension while the slurry is being pumped downhole is necessary. The carrier fluid may be either an aqueous-base or an oil-base liquid. Suitable aqueous-base liquids comprise water and brine. Suitable oil-base liquids include hydrocarbon oils and oil-base drilling muds. To obtain the requisite viscosity, thickening or gelling agents may be added to the carrier liquid. With water-base carrier fluids, thickening is accomplished by the addition of natural or synthetic gums such as guar gum, polysaacharides such as sugar, polymers such as polyacrylamide, cellulose derivatives such hydroxyethylcellulose (HEC) and the like. A typical hydroxyethylcellulose carrier fluid, for example, comprises up to 80 pounds of HEC or more per 1000 gallons of aqueous fluid. In some applications of on-the-fly mixing with relatively low gravel loadings, a thickener may not be required since a heavy brine may have sufficient suspension capacity to effect the gravel packing process.

In accordance with the invention, a slurry used for placement of the desired gravel pack should initially contain a low concentration of gravel material in suspension within the carrier fluid. Gravel loadings of five pounds per gallon of carrier fluid or less may be used while gravel loadings of two pounds per gallon or less are preferred. The gravel pack fluid is then pumped into the wellbore annulus.

With the low concentration of gravel in the carrier fluid, the gravel pack fluid migrates to those areas in the wellbore having the least resistance to the passage of fluid. Typically, this will be the well screen and through those well perforations penetrating into the most highly incompetent formations. As a "filter cake" of sand material builds up on the screen and/or within the perforations, fluid flow in those areas is restricted by the presence of this gravel pack which causes a diverting effect of the gravel pack fluid to areas of less permeability. This process continues until all of the perforations are filled and the well screen is coated with a layer of gravel material. This condition can be noted by an increase in pumping pressure at the surface.

In accordance with the invention, the gravel loadings in the carrier fluid are then gradually increased over time so that the process of building up a gravel bed within the perforations and on the screen and the diverting of additional gravel materials to less permeable areas of the wellbore continues until the required amount of gravel material has been placed in the wellbore, including sufficient gravel material above the well screen to act as a reservoir to fill any void spaces which may be present in the gravel pack or developed subsequently. This process allows a gradual increase in the hydrostatic pressure on the formation while the lower concentration stages help in restressing the formation.

The gradual increase in the gravel loading within the gravel pack carrier fluid can be accomplished in a stepwise manner by using several relatively small batches which begin with the low (less than or equal to 5, preferably 2, lb/gal) gravel loading and increases in a stepwise manner to a high (10 to 20 lb/gal) gravel loading over the course of the treatment. Alternatively, in accordance with the preferred embodiment of the invention, the gradual increase in the gravel loading in the carrier fluid can be accomplished through the use of an on-the-fly or continuous mix blender such as that described in U.S. Pat. No. 4,453,829. The blender described in this patent was developed for use in fracturing operations wherein fracture proppant loadings in a fracturing fluid can be smoothly and gradually increased over time to provide greater and greater amounts of proppant to a fractured formation. Sufficiently low pumping rates are available with this apparatus to allow its adaptation for use in a gravel pack operation as opposed to the high-pressure, high-flow rate application typically required in a formation fracturing process.

EXAMPLE

A cased gas well having four perforated producing zones over a total interval of 442 feet with a 39 degrees deviation and a bottom hole static pressure (BHSP) of 1750 PSI was completed in a single operation. After setting a packer at the top of the interval and pumping a prepad of 20 pounds HEC per 1000 gallons of fluid, a rotary blender of the type described in U.S. Pat. No. 4,453,829 was used to blend an initial slurry 2 pounds of 50–70 mesh sand into a viscosified aqueous solution containing 20 pounds HEC per 1000 gallons of solution. Thirty barrels of this solution was pumped into the interval through the gravel pack packer. The sand loading was then gradually increased in the blender in the same HEC solution to a sand loading (50–70 mesh) of 4 pounds per gallon and an additional 30 barrels of this fluid was pumped behind the original fluid. A sequence of 30 bbl, 20 bbl and 25 bbl of fluids having 6, 8 and 10 pounds per gallon sand loadings then followed (8 and 10 pounds per gallon loadings suspended in 60 pounds HEC/1000 gallon fluid). Upon normal completion operations of displacement, screen out and reverse circulation to remove excess slurry, a gravel pack log was run which showed the pack to be substantially free of bridges and/or voids with a reservoir of sand in place above the well screen.

The invention has been described and illustrated in conjunction with gravel packing of wells having a low bottom-hole pressure. It will be apparent to those skilled in the art that the process of this invention may also be used to great advantage in both normal and overpressured wells without departing from the process illustrated herein.

While the invention has been described in the more limited aspects of a preferred embodiment thereof, other embodiments have been suggested and still others will occur to those skilled in the art upon the reading and understanding of the foregoing Specification. It is intended that all such embodiments included within the scope of this invention is limited only be the appended claims.

Having thus described my invention, I claim:

1. A process for gravel packing in a wellbore annulus including a well screen and perforations extending into a producing formation comprising providing an initial gravel pack carrier fluid at below formation fracturing pressure and having a gravel loading of up to about five pounds gravel per gallon of carrier fluid within the wellbore annulus and, providing additional amounts of carrier fluid at below fracturing pressure and having gravel loadings which are successively higher than a preceding and the initial gravel loading to the wellbore annulus and continually increasing the gravel loading in the carrier fluid to a range of ten to twenty pounds of gravel per gallon of carrier fluid until the gravel packing of the wellbore annulus is completed.

2. The process as set forth in claim 1, wherein the step of providing additional increased the gravel loading comprises a step-wise increase in gravel loading.

3. The process as set forth in claim 1, wherein the step of increasing the gravel loading comprises continuously increasing the gravel loading in the carrier fluid.

4. The process as set forth in claim 1 further including the step of acidizing the formation following completion of the gravel pack process.

5. The process as set forth in claim 1, wherein said initial gravel pack carrier fluid has a gravel loading of up to about two pounds of gravel per gallon of carrier fluid.

* * * * *